US008201611B1

(12) United States Patent
Reich et al.

(10) Patent No.: US 8,201,611 B1
(45) Date of Patent: Jun. 19, 2012

(54) METHOD OF CENTRIFUGAL CASTING USING DRY COATED SAND CORES

(75) Inventors: David Reich, Mountain Brook, AL (US); Harry Reich, Birmingham, AL (US)

(73) Assignee: LaempeReich Corporation, Trussville, AL (US)

( * ) Notice: Subject to any disclaimer, the term of this patent is extended or adjusted under 35 U.S.C. 154(b) by 0 days.

(21) Appl. No.: 13/199,759

(22) Filed: Sep. 8, 2011

(51) Int. Cl.
*B22D 13/00* (2006.01)
*B22C 3/00* (2006.01)

(52) U.S. Cl. ..... 164/114; 164/14; 164/72; 427/185

(58) Field of Classification Search ..... 164/114–117, 164/14, 72; 427/459, 182, 185
See application file for complete search history.

(56) References Cited

U.S. PATENT DOCUMENTS 1,982,762 A * 12/1934 Russell et al. ..... 164/24
2,757,424 A * 8/1956 Daniel et al. ..... 164/195
2,948,934 A * 8/1960 Coupland, Jr et al. ..... 249/62
2,987,413 A * 6/1961 Dettling et al. ..... 427/185
3,305,900 A * 2/1967 Mulligan et al. ..... 164/21
3,419,409 A * 12/1968 Dettling ..... 427/185
3,506,060 A * 4/1970 Andrews ..... 164/118
3,520,711 A 7/1970 Bish et al.
4,240,495 A 12/1980 Vonnegut
4,381,354 A 4/1983 Kai et al.
4,934,440 A 6/1990 Sakakibara et al.
5,372,179 A 12/1994 Sakakibara et al.
6,036,777 A 3/2000 Sachs
6,316,047 B1 11/2001 Rowe et al.

* cited by examiner

*Primary Examiner* — Jessica L Ward
*Assistant Examiner* — Jacky Yuen
(74) *Attorney, Agent, or Firm* — Paul M. Sykes; Bradley Arant Boult Cummings LLP

(57) ABSTRACT

A method for centrifugal casting using a sand core having a refractory coating applied in a dry state, without the use of a liquid carrier, said coating sufficient to withstand the adverse forces of the centrifugal casting environment and yield a finished cast surface with a consistent, smooth surface. The coating may be applied by pressing the coating into a mixture of refractory material and impacting media fluidized in a vibratory bed such that the core floats in the mixture, and then rotating the core to coat the surfaces that will be in contact with the molten metal in the casting process.

10 Claims, 4 Drawing Sheets

METHOD OF CENTRIFUGAL CASTING USING DRY COATED SAND CORES

TECHNICAL FIELD

The invention relates generally to the field of casting metal objects, and in particular to centrifugally casting pipe using dry coated sand cores.

BACKGROUND

To cast a metal object having an internal void, a mold defines the exterior surface and shape of the object, and a core defines the interior surface and shape of the internal void. These cores are most frequently made of sand mixed with a binder, which is set by thermosetting or chemical bonding into the desired shape of the core, as known in the art. The core is fixed in place in the mold, and molten metal is poured into the space between the core and the mold to form the object. The smoothness of the interior surface of the cast object resulting from this process is a function of the smoothness of the surface of the sand core. The surface of the sand core is made of grains of sand, which if untreated leave a fairly rough surface on the cast object. Moreover, the molten metal can penetrate and damage the untreated surface of the sand core, resulting in additional blemishes and undesirable features in the interior surface of the cast object. It is therefore desirable to fill the voids between the sand grains at the surface of the cores in order to produce a finished cast surface in those areas in contact with the sand core, better than would have resulted without the coating, and to use a material that will protect the sand core from the harsh environment of the casting process.

Various prior art processes have addressed this problem. In some processes, a dry refractory powder is mixed with an impacting media. This mixture is fluidized in an air-driven fluidized bed, typically in an enclosed chamber of some kind. The sand casting is immersed in the fluidized mixture. In other processes, vibratory drives are used to fluidize the mixture to permit complete immersion of the core in the mixture. The impacting media forces the refractory powder into the spaces between the grains of sand in the surface of the sand core. This provides a smoother surface of the core, which results in a smoother interior surface of the object. In addition, the refractory powder has a melt point exceeding that of the molten metal poured into the mold and thus protects the surface of the sand core from degradation caused by contact with the molten metal.

However, these techniques of coating with a dry powder have been limited to gravity casting, in which the mold is stationary and molten metal is poured into and simply fills the mold. The degree of attachment of the refractory material to the sand grains and the extent to which voids between the sand grains are filled is satisfactory for a gravity casting process, but has been found to be inadequate when the core is subjected to the particular forces encountered in the centrifugal process.

The general process of centrifugally casting a pipe will be described by way of example. The process of producing pipe by the centrifugal process utilizes a sand core to create detail in the enlarged end of the pipe casting to receive gaskets or seals used to seal the connection when one pipe is inserted into the next pipe in an installation. This sand core also serves as a restraint to prevent the molten metal from flowing out of the end of the mold during the casting process. The conditions to which such a sand core is subjected in this process are severe and distinctive from those in gravity casting processes.

In the production of pipe by the centrifugal process, the sand core is inserted into the enlarged end of the metal pipe mold, either mechanically, or by hand, and then secured by a mechanical clamping device, or by manually inserting clamps or wedges of various configurations. The mold is then moved laterally around a trough designed to carry the molten metal from which the pipe is to be cast.

The mold then begins rotating at a defined speed and molten metal at a temperature in the range of about 2200 F (approximately 1200 C) to about 2800 F (approximately 1500 C) is introduced at the end of the trough opposite the cored end. The metal flows along the trough in a lateral direction and exits the trough in the vicinity of the sand core. The laterally flowing metal impacts the rotating core and flows against and along the surface of the core until the annular space between the core and the pipe mold is completely filled by the centrifugal force created by the rotating mold against the mass of the molten metal. The mold and the metal contained therein continue to rotate until the molten metal has sufficiently solidified to allow the pipe to be extracted from the mold. During the solidification process, the core is subjected to the centrifugal force of the molten metal.

The core is therefore subjected to two different forces of the molten metal. Initially, the metal washing against the surface of the core tends to erode the core, washing away sand grains at the surface of the core. Secondarily, the core is subjected to pressures created by the centrifugal force of the molten metal. This tends to force the molten metal into spaces between the sand grains at the surface of the core. During the solidification process, the binder utilized in the sand core is decomposed by the heat of the molten metal and the products of combustion migrate through the core to the annular interior of the core where they can easily exit the mold through its open end.

Known dry coating processes do not impart a coating of sufficient durability to withstand the forces to which a sand core is subjected during centrifugal casting. To adequately coat a core to be used in centrifugal casting with a suitable refractory, a wet coating process has been used. The refractory material is typically suspended in a fluid, water or various chemical solvents, and then applied by painting, spraying, dipping, or other such methods used for applying liquid coatings. Following the application of the liquid coating, the liquid portion must be driven off so as to leave a dry refractory surface which will be presented to the molten metal. To optimize the flowability, specific gravity, and other such characteristics of the refractory coating, as well as to assure the bonding of the coating to the core, and the filling of the voids between the cores, various minerals, clays, and other materials are added to the coating.

This wet coating process suffers from several problems. First, coating with a liquid refractory by spraying or brushing allows the possibility of incomplete coverage of the surface of the core, such as by "shadows" created by the complex surface contours of the core. Dipping of the core likewise allows the possibility of uneven coating thickness. Second, the coating must be dried before the core can be used. This adds a step to the manufacturing process. Additionally, the drying step requires the purchase, maintenance, and operation of additional capital equipment on the shop floor, adding to the cost of the finished product. The drying process itself introduces variables into the quality of the surface of the core, and thus of the casting. In particular, care must be taken during the drying process that the fluid used to create the coating does not penetrate the core, thus compromising the bond between sand grains, and also that the vapor created in the drying process does not separate the refractory from the surface of the sand grains. Significant measures for process control must be undertaken to address these variables and obtain acceptable results. The wet coating process often results in a cast surface which can have defects created by the lifting of the applied coating and causing it to be captured under the surface of the metal, and also penetration of the liquid metal though the coated surface, resulting in a rough surface of the cored portion of the pipe. Wet coated cores also leave a residue in the pipe, which further adheres to the metal, such as iron, during the annealing process and which must be cleaned out. Both of these conditions typically require subsequent grinding and gauging of the cored surface to meet specified dimensional and surface finish requirements, which adds process time and labor cost.

Thus, there exists a need for a process of centrifugally casting that utilizes a sand core having a coating applied by a dry coating process, which does not require a pre-casting drying step, and which yields a finished surface that does not require post-casting grinding and gauging. It also is desirous to coat the surface of the core with only the refractory material required to resist the forces applied to the core and to eliminate the use of liquids to apply the refractory, and other minerals, clays, and other materials which do not contribute to the resistive properties of the coating.

SUMMARY

Embodiments of the present invention satisfy these needs. One embodiment of the present invention comprises a method of centrifugally casting iron pipe in a cylindrical mold comprising fixing in the cylindrical pipe mold a sand core having a refractory coating applied in a dry state without the use of a liquid carrier, rotating the mold at a predetermined speed, and, while rotating the mold, flowing molten metal into the space between the sand core and the pipe mold and then allowing the metal to cool until a predetermined state of solidity is reached. Then the pipe is removed from the mold. In one embodiment, the sand core has a refractory coating applied in a volume of 0.005 to 0.010 cubic centimeters per square centimeter of coated surface area of the core. In a preferred embodiment, the coating may be applied by pressing the core against a fluidized mixture of an impacting media and a refractory material, where the mixture is fluidized to a density at which the core floats in the mixture with a desired degree of submersion and then rotating the core about its primary axis with the core bearing against the mixture. The mixture may be fluidized with a vibratory drive that imparts a circulatory flow in the mixture. The sand core may be positioned at a predetermined angle to the surface of the fluidized mixture to limit the areas of the sand core to which the coating is applied, and still more preferably the degree of submersion of the sand core in the fluidized mixture corresponds to a depth sufficient to coat only those portions of the sand core that will form a surface of the metal casting. The impacting media and coating material have refractory properties, with the coating material having a particle size not greater than 220 mesh and a melt point of not less than 1200 C, selected based upon the temperature of the molten metal to be used in the casting process. (The melt point of the refractory material exceeds that of the molten metal). The coating should have sufficient depth and uniformity to yield a centrifugally cast surface having an surface roughness measurement between about 120 to 200, measured using a GAR C-9 scale microsurface comparator.

BRIEF DESCRIPTION OF THE DRAWINGS

The present invention will be explained, by way of example only, with reference to certain embodiments and the attached Figures, in which.

DETAILED DESCRIPTION

Figure 1:
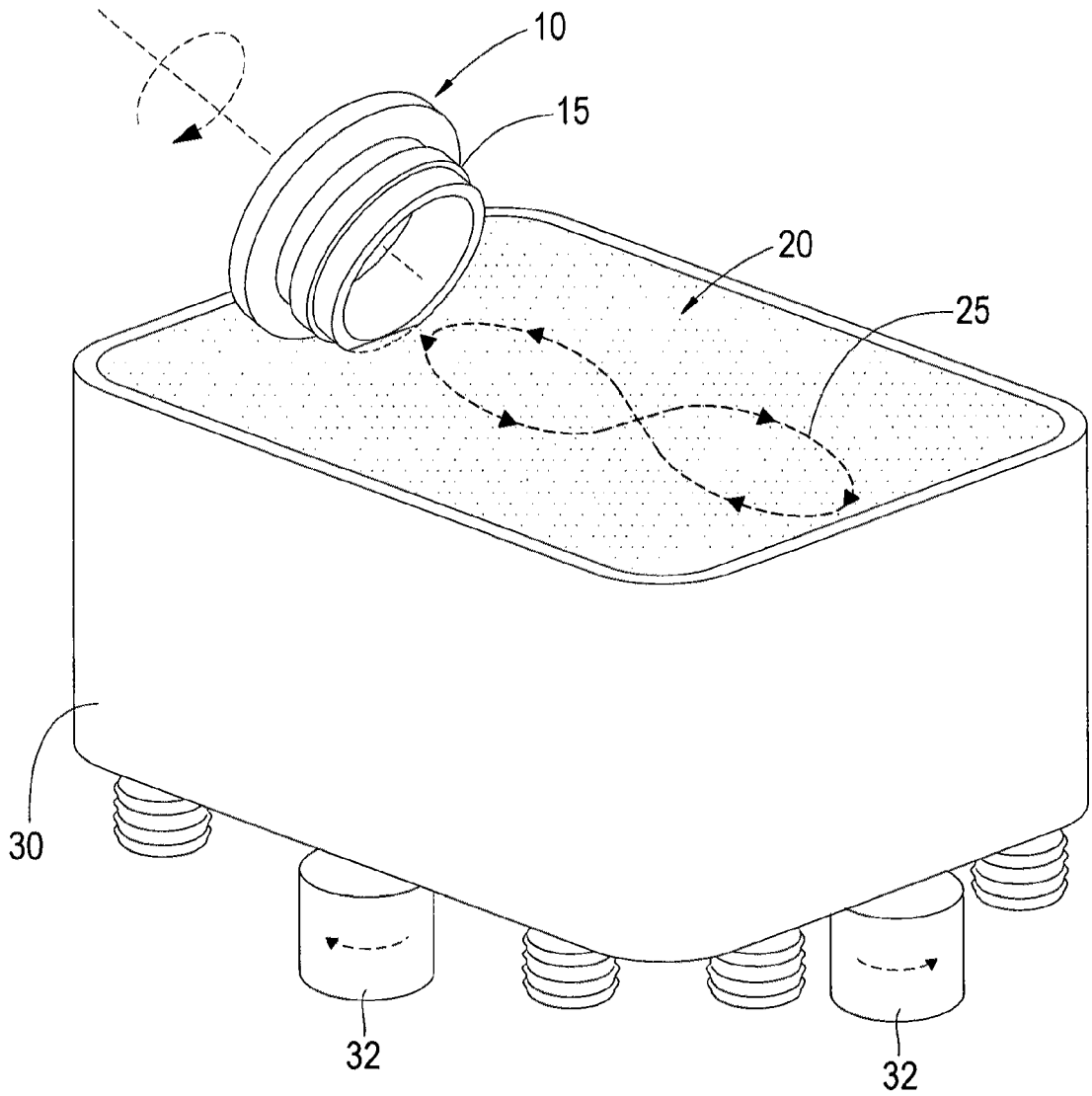
FIG. 1 is a perspective view of a sand core being coated in accordance with one embodiment of the present invention.

As shown in FIG. 1, in one embodiment of the present invention, a sand core 10 is pressed into a mixture 20, until partially submerged therein, with the mixture being contained and fluidized sufficiently to circulate within a vibratory tub 30, as described in more detail herein. The exemplary sand core 10 has an outer surface with contours defining the shape of the interior surface of the object to be cast. The sand core 10 shown in FIG. 1 is a core for use in casting the shaped or bell end of a centrifugally cast pipe, but it should be understood that the shape and size of the core will vary with the intended application, and embodiments of the present invention are not limited to any particular shape or application. The sand core 10 has an outer surface 15 that will be in contact with the molten metal during the casting process. As shown in detail in FIG. 2, the sand core 10 is made of individual grains of sand 18 bonded together, which leaves the surface 15 uneven with rough depressions and protrusions shaped by the outer layer of the grains of sand 18.

Figure 2:
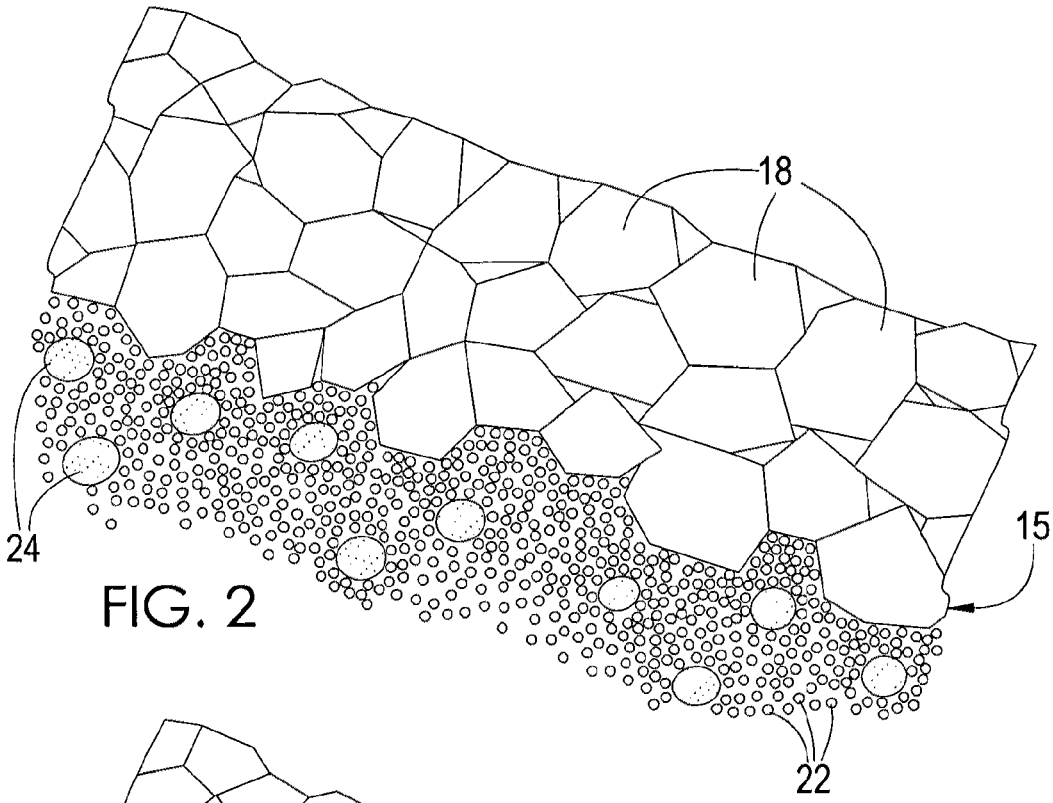
FIG. 2 is a detail view of the surface of a sand core in contact with the fluidized surface of a coating mixture achieved by the embodiment shown in FIG. 1.

Referring to FIGS. 1-2, the mixture 20 in the vibratory tub 30 comprises a refractory coating material 22 and an impacting media 24. The refractory coating material can be any of several refractory minerals of grain fineness, typically about 220-325 mesh, compatible with the grain size of the sand used in producing the core and capable of preventing penetration of liquid metal of a temperature typically used in the production of the cast object. The impacting media is typically a 20-30% larger grain, preferably spherical in shape, and usually of a lesser density than the refractory coating material. The refractory material must have a melt point higher than the temperature of the molten metal used in the casting process. Depending on the specific alloy used and the temperature selected for the molten metal, the melt point of the refractory coating could be as low as about 1200 C. The size of the particle is selected based on the compatibility with the sand core material and desired surface smoothness of the cast object. For example, where the sand core is made of a relatively rough grain sand, the particle size of the refractory coating may be as low as 220 mesh. In a preferred embodiment, for use with ductile iron pipe, a pulverized refractory material with a mesh size of not less than 325 and a melt point greater than 2000 C is used. In a still further preferred embodiment, the powder material is zircon and the impacting media is zircon sand. Other suitable refractory materials include fused alumina and mullite. Other suitable impacting media include ceramic beads and silica sand.

Figure 3:
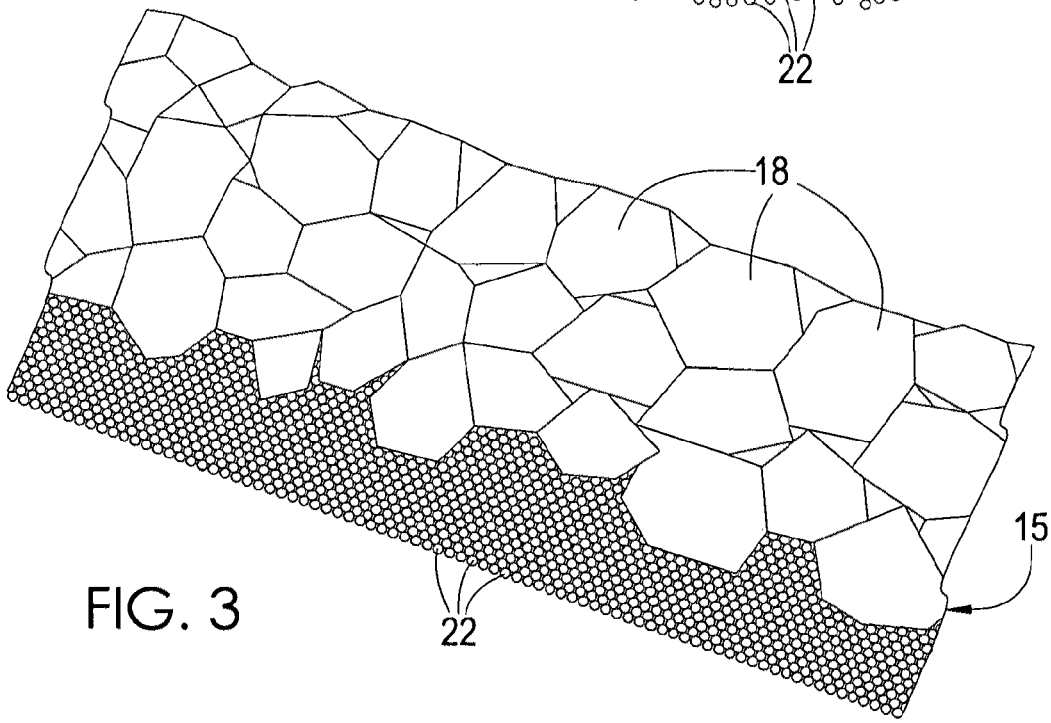
FIG. 3 is a detail view of the surface of the sand core after coated in accordance with the present invention.

The vibratory tub 30 is a mechanically driven vibratory tub, in which the force, rotational speed, and angle of attack of the vibratory units 32 attached to the tub are adjustable. In one embodiment, the tub 30 is partially filled with the mixture 20 and the vibratory units 32 are adjusted so as to create a circulatory flow 25 of the mixture 20 in the tub, but not as to create a bed fluidized to the extent that the cores will submerge in the mixture 20 of their own weight. As a result, the cores tend to float on the surface of the circulating mixture 20. A force may be applied to the core sufficient to cause a segment of the surface 15 that will be exposed to the molten metal to be submerged in the mixture 20, as shown in FIG. 1, and thereby bring this surface into contact with the refractory coating material 22. Thus, the surface 15 of the core 10 presses against the mixture 20 under the weight of the core, as well as the additional force, if any, applied to partially submerge the surface 15 to be coated. The steps of partial submersion and rotation may be performed manually, mechanically, or a combination thereof, with any machine known in the art suitable for such purposes, such as an industrial robot. The cores are then rotated in the mixture 20, which causes a dragging and smearing action of the core surface 15 against the mixture 20. This results in even distribution of the coating material 22 and achieves a mechanical attachment of the coating material to the core sand grains on surface of the core to fill the voids between the sand grains on the surface of the core. FIG. 3 illustrates conceptually the surface 15 of the core 10, after being coated as described above.

As shown in FIG. 1, the central axis of sand core 10 may be angled with respect to the surface of the fluidized mixture 20. The angle is selected visually so as to only apply the refractory material to those areas which will be in contact with molten metal. In addition, rotating the core as shown controls the surfaces that are coated and thus tends to coat only those surfaces that will be in contact with the molten metal in the mold. Excess refractory material falls back into the tub 30. This process thus reduces waste relative to overspray in wet coating processes, and relative to the complete immersion of the core (which coats surfaces that do not need coating) in previous dry coating processes.

In this embodiment, the ratio of the refractory coating material to the impacting media is not critical, because the forces applied by the core weight, the circulatory motion of the mixture 20, and the rotation of the core in the circulating mixture 20 assures a complete coating of the core surface 15. The dragging and smearing action of the core against the refractory media while being rotated provides a dry refractory coating of the surface 15 of the core 10 that will be exposed to the liquid metal. The coating is uniformly applied by the process and firmly pressed into the surface of the core. Although the weight of the coating applied will vary depending on the specific gravity of the specific refractory coating used, the amount of material applied can be quantified by volume of coating per unit area of coated surface.

In one embodiment, in a sand core used in centrifugal cast pipe and using a coating material with bulk density range of 2.80 to 3.6 grams/cubic centimeter (g/cc), it was determined that by volume, a coating of approximately 0.005 to 0.01 cubic centimeter per square centimeter of coated core area (0.002 to 0.004 cubic inches per square inch) was adequate, with an optimum coating of about 0.0078 cubic centimeters per square centimeter (0.003 cubic inch per square inch). Thus, for a sand core for an eight-inch diameter pipe, with a coated surface area of 210 square inches, the volume of the refractory coating applied was 10.5 cubic centimeters. For a twelve-inch diameter sand core with surface area of 340 square inches, the volume of the refractory coating was 17 cubic centimeters.

In production, the amount of coating applied to the core is determined by the additive weight of the coating on the core, based upon the specific material used. When this falls below predetermined a level, an additional quantity of coating material is added to the impacting media in the vibratory tub. For example, in one embodiment, in a sand core used for centrifugal cast pipe and using a coating material of zircon flour having a mesh size of 325, it was determined that by weight, a coating of about 140 to 280 grams per square meter (about 0.0002 to 0.0004 pounds per square inch) was adequate, with an optimum coating of about 210 grams per square meter (about 0.0003 pounds per square inch). Thus, for a sand core for an eight-inch diameter pipe, with a surface area of 210 square inches, the weight of the refractory coating 22 applied was 0.06 pounds. For a twelve-inch diameter sand core with a surface area of 340 square inches, the weight of the refractory coating 22 applied was 0.1 pounds. If the coating density achieved in the process is less than the desired coating density, then additional refractory coating material 22 is added to the mixture 20 until the proper density is achieved.

The foregoing process provides a consistent, uniform coating with good adherence to the surface of the sand core. Unlike the wet coating processes of the prior art, no post-coating processing or treatment is necessary. And, unlike the surfaces achieved dry coating processes used in gravity casting, the adherence and weight of the coating achieved by embodiments of the present invention withstand the forces of centrifugal casting.

Figure 4:
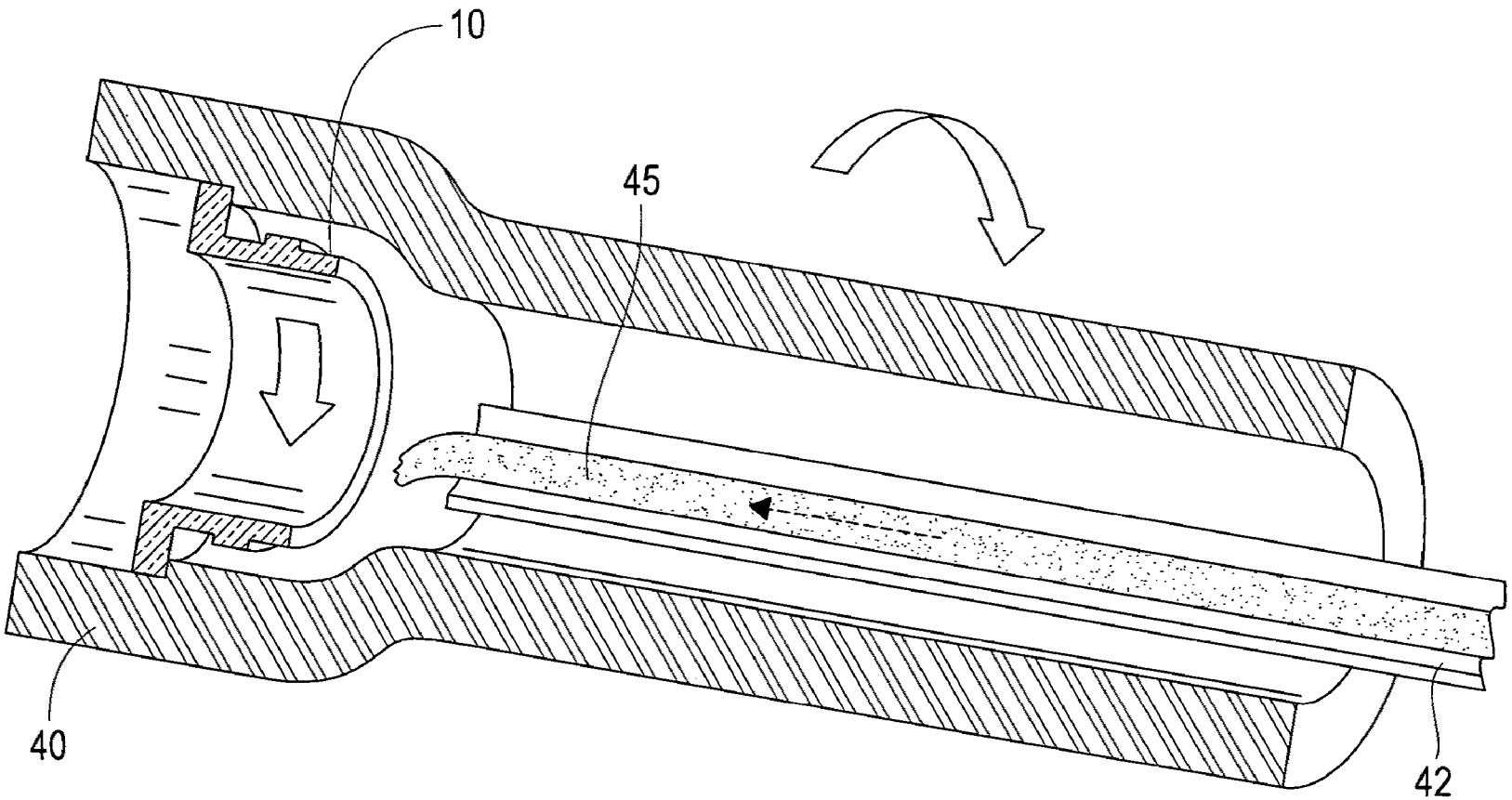
FIG. 4 is a perspective, sectional view of a pipe being centrifugally cast in accordance with an embodiment of the present invention.

As shown in FIG. 4; to cast a pipe in accordance with one embodiment of the present invention, a sand core 10 having a refractory coating applied in a dry state, with the characteristics described above, is fixed into the shaped end of a pipe mold 40. The pipe mold 40 is rotated to a predetermined speed, as is known by those of ordinary skill in the art. A trough 42 is inserted longitudinally into the pipe mold 40 from the open end. Molten metal 45, at a temperature ranging from about 1200 to 1500 C (depending on the particular alloy being used), flows down the trough and fills the space between the inner surface of the pipe mold 40 and the outer coated surface of the sand core 10. The trough 42 is retracted at a predetermined rate as the mold 40 continues spinning, casting the remainder of the pipe. The mold continues to spin as the molten metal cools to a desired degree of solidity, at which time the mold is allowed to come to rest and the cast pipe is removed from the mold.

Figure 5A:
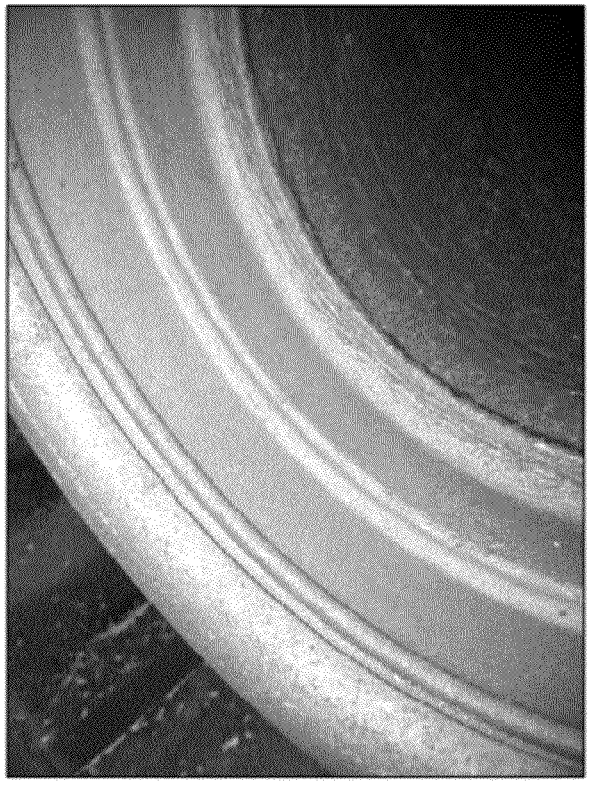
FIG. 5A is a photograph of the finished surface of a centrifugally cast pipe that is made in accordance with an embodiment of the present invention.
Figure 5B:
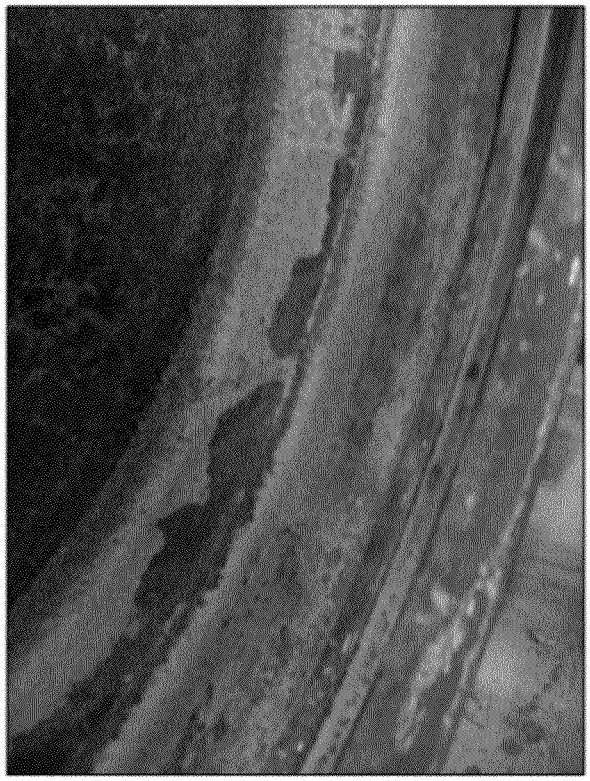
FIG. 5B (Prior Art)
FIG. 5B is a photograph of a finished surface of a centrifugally cast pipe that is made in accordance with a prior art wet coating process.

Centrifugal casting with a dry coating as described herein results in a cast surface of superior quality, free from defects, and which surface requires no grinding or other such surface finishing. FIG. 5B is a photogaph of a finished surface of a centrifugally cast pipe that is made in accordance with a prior art wet coating process, and FIG. 5A is a photograph of a centrifugally cast pipe that is made in accordance with an embodiment of the present invention. The cast surface finish achieved using embodiments of the present invention, measured using the industry standard RMS Surface Roughness Scale, is 120 to 200 using a GAR C-9 scale microfinish comparator, such as that manufactured by is Gar Electroforming Division. (See generally ANSI/ASME Specification B.46.1, "Surface Texture (Surface Roughness, Waviness, and Lay"). By contrast, prior art processes yield GAR surface roughness scale measurements typically exceeding 200, up to about 560.

Pipe cast in accordance with embodiments of the present invention are free of debris from the core coating material, free from core coating material imbedded in the casting, as well as sand from the core adhering to the cast surface, all of which are typically found in pipe cast with cores using conventional coating in the same plant under the same casting conditions.

Although the present invention has been described and shown with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

What is claimed is:

1. A method of centrifugally casting iron pipe in a cylindrical mold, comprising:

coating a sand core by pressing the core against a fluidized mixture of an impacting media and a refractory material, without the use of a liquid carrier, said mixture fluidized to a density at which said core floats in said mixture with a desired degree of submersion and rotating the core about its primary axis with the core bearing against said mixture;

fixing said coated sand core in the cylindrical mold, the shape of an end of said pipe defined by the space between said core and said mold;

rotating said mold at a predetermined speed, and, while said mold is rotating:

flowing molten metal into said space;

allowing said metal to cool until a predetermined state of solidity is reached; and removing said pipe from said mold.

2. The method of claim 1, wherein said fluidized mixture is fluidized with a vibratory drive that imparts a circulatory flow in said fluidized mixture.

3. The method of claim 1, wherein said core is rotated about its primary axis at a predetermined angle to the surface of the fluidized mixture to limit the areas of the sand core to which the coating is applied.

4. The method of claim 1, wherein the desired degree of submersion corresponds to a depth sufficient to coat only those portions of the sand core that will form a surface of the metal casting.

5. The method of claim 1, wherein the impacting media and coating refractory material have refractory properties and the refractory material has a particle size not greater than 220 mesh and a melt point not less than 1200 C.

6. The method of claim 1, wherein the coating has a volume of about 0.005 to 0.010 cubic centimeters per square centimeter of coated surface area of the core.

7. The method of claim 1, wherein said refractory material has a particle size of not greater than 200 mesh and a melt point greater than 1200 C, said coating of sufficient depth and uniformity to yield a centrifugally cast surface having a surface roughness measurement between about 120 to 200, measured using a GAR C-9 scale microsurface comparator.

8. A method of centrifugally casting iron pipe in a cylindrical mold, comprising:

coating a sand core by the steps of:

fluidizing in a tub with a vibratory drive a mixture of an impacting media and a refractory material, without the use of a liquid carrier, sufficiently to impart a circulatory flow to said mixture in said tub;

submerging the sand core in said mixture, wherein said mixture is fluidized to a density at which said core floats in said mixture with a desired degree of submersion;

rotating the core about its primary axis with the core bearing against the mixture;

fixing said coated sand core in the cylindrical mold, the shape of an end of said pipe defined by the space between said core and said mold;

rotating said mold at a predetermined speed, and, while said mold is rotating:

flowing molten metal into said space;

allowing said metal to cool until a predetermined state of solidity is reached; and removing said pipe from said mold.

9. The method of claim 8, wherein said core is rotated about its primary axis at a predetermined angle to the surface of the fluidized mixture to limit the areas of the sand core to which the coating is applied.

10. The method of claim 8, wherein the desired degree of submersion corresponds to a depth sufficient to coat only those portions of the sand core that will form a surface of the metal casting.

* * * * *